United States Patent [19]

Szadkowski et al.

[11] 4,202,473

[45] May 13, 1980

[54] REVOLVING SLIDE GATE MECHANISM

[75] Inventors: Stanislav Szadkowski, Brussels, Belgium; Daniel Amory, Dunkerque, France; Jean M. Thomas, Xhoris, Belgium

[73] Assignee: Vesuvius International Corporation, Wilmington, Del.

[21] Appl. No.: 956,939

[22] Filed: Nov. 2, 1978

[30] Foreign Application Priority Data

Nov. 15, 1977 [GB] United Kingdom ..... 47515/77

[51] Int. Cl.[2] ..... B22D 41/08

[52] U.S. Cl. ..... 222/598; 222/555; 251/188; 222/512

[58] Field of Search ..... 164/437; 251/187, 188, 251/206; 222/598, 512, 555, 557, 560, 545, 561

[56] References Cited

U.S. PATENT DOCUMENTS

| | | | |
|---|---|---|---|
| 3,430,644 | 3/1969 | Lyman | 222/598 |
| 3,764,047 | 10/1973 | Inoue et al. | 222/598 |
| 3,921,866 | 11/1975 | Palazzo | 222/598 X |

FOREIGN PATENT DOCUMENTS

| | | | |
|---|---|---|---|
| 1281643 | 10/1968 | Fed. Rep. of Germany | 222/598 |

*Primary Examiner*—David A. Scherbel

*Attorney, Agent, or Firm*—Sughrue, Rothwell, Mion, Zinn and Macpeak

[57] ABSTRACT

This invention provides a rotary slide gate mechanism for use on a pour vessel to control flow of molten metal through at least one outlet in the vessel shell, whereby refractory insert plates which are conveyed by said mechanism, may be moved in very close cooperating contact with a perforated refractory outlet plate for the pour vessel, so as to control the flow of molten metal therethrough.

26 Claims, 7 Drawing Figures

REVOLVING SLIDE GATE MECHANISM

SUBJECT MATTER OF THE INVENTION

This invention relates to a slide gate mechanism for controlling flow of molten metal from a vessel containing such molten metal, hereinfurther referred to as a "pour vessel".

More particularly it relates to such a mechanism comprising refractory plates which may be moved in a rotary movement in front of a refractory outlet plate for the pour vessel, whereby there is always provided a close cooperating contact between said refractory outlet plate for the pour vessel and that refractory plate of the slide gate mechanism, which is moved or positioned in front of it.

THE PRIOR ART

Slide gate mechanisms for use on pour vessels for molten metal, comprising more than one refractory plate which may be moved in front of a refractory outlet of the pour vessel, are already known in the art of casting metals.

Thus, there is known a rotary gate mechanism for a pour vessel which includes a rigid valve or gate, comprising a plurality of removable refractory inserts rigidly retained therein, whereby said rigid valve is urged against the outlet in the vessel by means of one single centrally located spring. Such a mechanism has however the drawback that its rigid construction and the central position of the spring therein, do not allow a sufficiently close and tight contact between the refractory inserts and the outlet of the vessel; this may result in leakage of molten metal during the pouring.

Furthermore, in the known slide gate mechanism the pushing systems urging the slide gates against the outlet in the vessel, are arranged at or near the working position of said slide gates, which means in the vicinity of the outlet in the vessel, and in the heat radiating area thereof. This arrangement results in a substantial vulnerability of the pushing system.

BRIEF DESCRIPTION OF THE INVENTION

It is an object of the present invention, to provide a slide gate mechanism for use on a pour vessel for molten metal which avoids the above drawbacks of the known mechanisms, allows pouring or casting of metal in a much easier way and opens new, unexpected possibilities in the field of pouring or casting metal.

This new slide gate mechanism therefor comprises a rotary moving frame conveying refractory insert plates, in a free swiveling manner, in front of the vessel outlet or outlets, and a lever pushing system for urging, from outside the heat radiating aria of said outlet, said refractory insert plates towards said outlet when they are in the vicinity of the outlet..

DETAILED DESCRIPTION OF THE INVENTION

The slide gate mechanism, according to the invention for use on a pour vessel to control flow of molten metal through at least one outlet in the vessel shell, comprises:

- a moving frame able to rotate in a plane substantially parallel to the outlet or outlets in the vessel shell, around a central shaft fixed to the vessel shell or to a mounting plate attached thereto;
- at least two refractory plate supporting frames on the periphery of said rotary moving frame and connected thereto by means of a connection allowing each supporting frame to swivel on the one end in a rotation plane extending radially in respect to said central shaft, and on the other end around a rotation axis which is perpendicular to the axis of the rotation of said supporting frame in said radially extending rotation plane;
- a number of interchangeable refractory insert plates, each plate being supported by one supporting frame in such a manner that said refractory insert plates are able to swivel around an axis which is substantially parallel to the axis of rotation of said supporting frame in said radially extending rotation plane, whereby the lateral edges of two adjacent refractory insert plates form with respect to each other a substantially tight seal and whereby at least one of said refractory insert plates has an aperture which may be brought in alignement with the outlet or outlets in the vessel shell;
- a pushing system for urging said refractory plate supporting frames, when they are in the vicinity of the outlet or outlets in the vessel shell, towards said outlet or outlets, said pushing system comprising at least one lever and force supplying means, removed from the heat radiating area of said outlet or outlets, acting on said lever or levers;
- a system for imparting a rotary movement to the rotary moving frame of the mechanism; whereby the refractory insert plates may be moved in very close cooperating contact with a perforated refractory plate for the outlet or outlets in the vessel shell, so as to control the flow of metal therethrough.

According to one particular feature of the invention, the rotary slide gate mechanism thereof is preferably as a whole, supported by said central shaft, and may, as a whole, be removed from said central shaft and from the pour vessel on which it is used.

In one specific embodiment of the rotary slide gate mechanism according to the invention, each refractory plate supporting frame of the rotary slide gate mechanism is connected to a supporting frame support by means of a spindle of said supporting frame extending radially with respect to said central shaft into a corresponding bore of the supporting frame support, in a free swiveling manner, thus allowing the swiveling movement of said supporting frame around said rotation axis, which is perpendicular to the axis of the rotation of said supporting frame in said radially extending rotation plane, said supporting frame support being itself connected to the rotary moving frame by means of a connection allowing the supporting frame support to swivel together with said supporting frame in said radially extending rotation plane.

According to a particular feature of this embodiment each supporting frame support may be connected to the rotary moving frame by means of pins engaged into slots, the common axis of said pins extending perpendicular to said radially extending rotation plane, thus allowing the swiveling movement of said supporting frame support together with said supporting frame in said radially extending rotation plane and the easy removal of said supporting frame support together with said supporting frame by tilting, in an area where said supporting frame is not urged by said pushing system.

In a further embodiment of the rotary slide gate mechanism according to the invention, each refractory insert plate bears upon one supporting frame by means of a hinge, the swivel axis of which is substantially parallel to the axis of the rotation of said supporting frame in said radially extending rotation plane, whereby according to particular features of the invention, each refractory insert plate may comprise two coaxial pins adapted to pivot in two notches of one supporting frame, or each refractory insert plate may comprise two notches adapted to pivot on two coaxial pins of one supporting frame.

In still a further embodiment of the rotary slide gate mechanism according to the invention, the lever or levers of the pushing system urging the refractory plate supporting frames, when they are in the vicinity of the outlet or outlets in the vessel shell, towards said outlet or outlets, each have their respective fulcrum located between the point where the lever urges said refractory plate supporting frames and the point where said force supplying means act upon said lever, whereby according to particular features of the invention the lever or levers may act upon the refractory plate supporting frame or on the supporting frame support.

According to one other particular feature of the invention, each lever comprises near its end acting upon the refractory plate supporting frames, a transverse beam, the length of which is such that it can only be in contact with one refractory plate supporting frame or supporting frame support at the same time.

In one further specific embodiment of the rotary slide gate mechanism according to the invention, the pushing system urging the refractory plate supporting frame or frames, in the vicinity of one outlet in the vessel shell, comprises three levers, each of said levers being provided with independent force supplying means, whereby one of said levers urges the refractory plate supporting frame located or moving in front of the outlet in the vessel shell, whereas the two remaining levers are adapted to urge the refractory plate supporting frames approaching and leaving the position in front of the outlet.

More specifically, the lever urging the refractory plate supporting frame located or moving in front of the outlet in the vessel shell may consist of two parallel legs extending along opposite sides of said central shaft and connected to each other by means of at least two transverse pieces at the extremities of said legs, whereby one transverse piece is adapted to urge said supporting frame located or moving in front of the outlet and one transverse piece is adapted to be urged by its force supplying means and whereby the levers urging the refractory plate supporting frames approaching and leaving the position in front of the outlet in the vessel shell may extend on each side of said central lever having two parallel legs.

In another specific embodiment of the rotary slide gate mechanism according to the invention, the fulcrum of each lever is positioned near the central shaft of the mechanism, whereby the one extremity of the lever urges said refractory plate supporting frame or frames towards one outlet in the vessel shell, whereas the other extremity of the lever extends in opposite direction to a point which is outside the periphery of the rotary moving frame and of the supporting frames connected thereto, the force supplying means being located at that point.

According to another particular feature of the invention, the rotary slide gate mechanism thereof may comprise a fixed cover frame, adapted to support the refractory plate supporting frames or the supporting frame supports in the area where the refractory plate supporting frames are not urged by the pushing system.

According to the invention, the force supplying means of the rotary slide gate mechanism may be selected among springs, hydraulic or pneumatic jacks, counterweight, magnets, electromagnets and the like.

The refractory plate supporting frames may in particular consist of forks supporting, in a free swiveling manner, the lateral edges of said refractory insert plates.

According to another feature of the invention, the rotary moving frame of the rotary slide gate mechanism may be supported on bearings.

In a further embodiment of the rotary slide gate mechanism according to the invention, the system for imparting a rotary movement to the rotary moving frame consists of a motor and gears transmitting the motion of the motor to a driving gear provided on said rotary moving frame, whereby the motor may in particular be an electromotor.

According to further features of the invention the rotary movement of the rotary moving frame may perform in both directions and/or at two or more different speeds.

In a further preferred embodiment of the rotary slide gate mechanism according to the invention, apertures of different shapes and/or cross sections are provided in at least one of said refractory insert plates, whereby at least one of said refractory insert plates is adapted to close an outlet in the vessel shell in front of which it is moved or positioned, thus allowing regulation of the flow of molten metal through an outlet in the vessel shell by selecting the refractory insert plate and/or refractory insert plate portion to be positioned in front of the outlet.

In accordance with the invention, at least one of the refractory insert plates of the rotary slide gate mechanism of the invention may have an entirely closed surface of refractory material.

Further, in accordance with the invention, there are preferably at least five refractory plate supporting frames arranged on the periphery of the rotary moving frame.

FIGURES

Other features and details of the invention will appear from the following detailed description, in which reference is made to the attached drawings which represent by way of a purely illustrative example one specific embodiment of the rotary slide gate mechanism according to the invention.

In these drawings.

In these various figures like reference characters are employed to designate the same parts.

Figure 1:
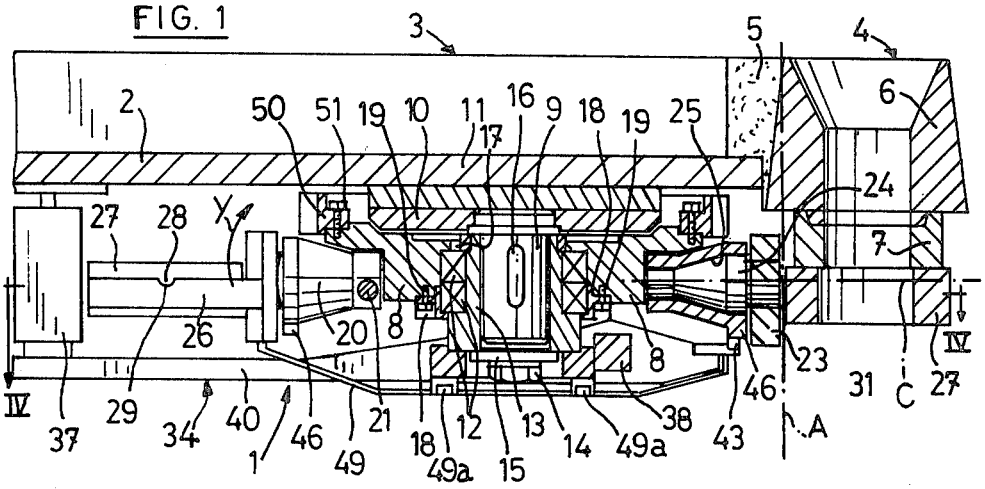
FIG. 1 is a side plan view, partially in section, of one embodiment of the rotary slide gate mechanism according to the invention.
Figure 2:
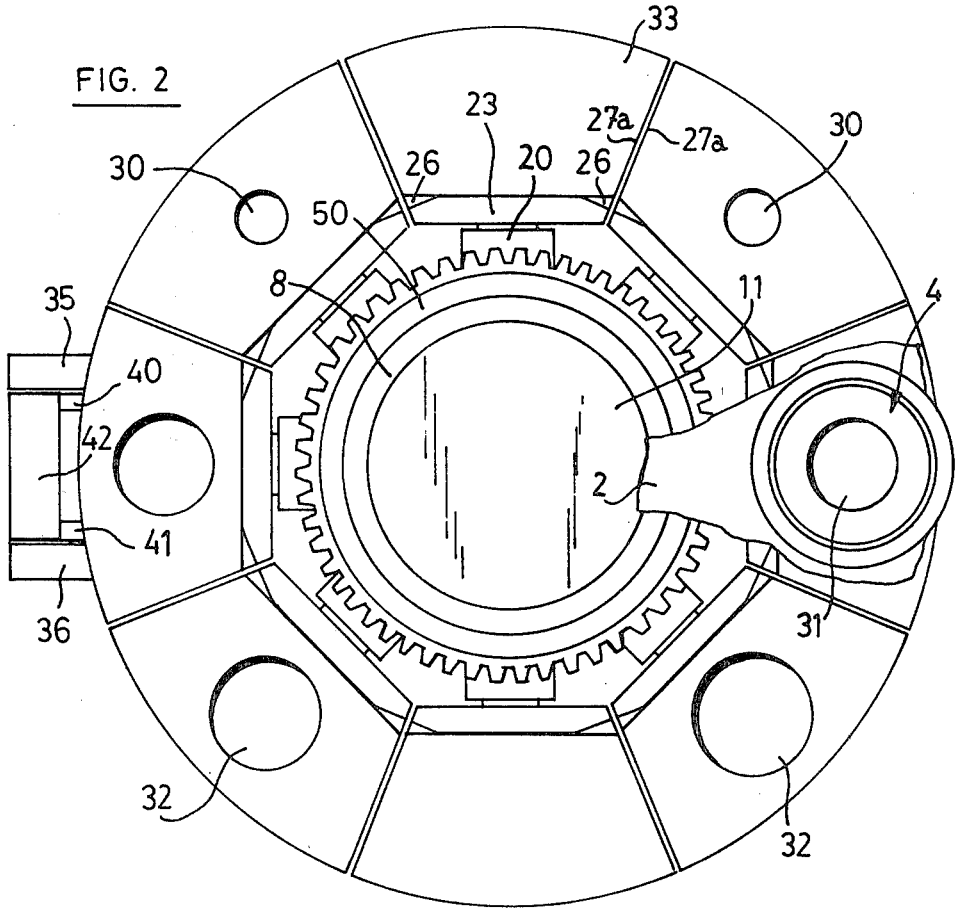
FIG. 2 is a top plan view of the mechanism of FIG. 1.

The rotary slide gate mechanism according to the invention, as shown in particular in FIGS. 1 to 4, designated, as a whole, by the reference character 1, is arranged on an outer shell 2 of a pour vessel for molten metal designated, as a whole, by the reference character 3.

Said pour vessel comprises an outlet 4, constituted by a refractory well block 5 and a refractory inner nozzle 6.

The rotary slide gate mechanism according to the invention, as shown in particular in FIGS. 1 to 4, comprises a moving frame 8, able to rotate in a plane substantially parallel to a refractory plate 7 (so-acalled "upper plate"), which is positioned at the vessel outlet 4, around a central shaft 9 fixed to a mechanism mounting plate 10 attached to a vessel mounting plate 11, fixed to the vessel shell 2.

The rotary moving frame is supported on bearings 12, rolling on the outer surface of a shaft socket 13, which is attached to the shaft 9 by means of a bolt 14 and washer 15, and secured to said shaft 9 by means of a key 16. The bearings 12 are maintained in their position by a bearing nut 17 fixed to said shaft socket 13, and by a cage bearing 18 fixed to the rotary moving frame by means of bolts 19.

The rotary slide gate mechanism according to the invention, as shown in particular in FIGS. 1 to 4, comprises further eight supporting frame supports 20, connected to the rotary moving frame 8 by means of pins 21 provided on said supporting frame supports, and engaged into slots 22 provided in the rotary moving frame 8, thus allowing each of said supporting frame supports to swivel in a rotation plane A-C (defined by two lines A and C) extending radially with respect to said central shaft 9, around an axis B passing through the center of said pins 21.

To each supporting frame support 20 there is connected one refractory plate supporting frame 23, by means of a spindle 24 of said supporting frame, extending radially with respect to the central shaft 9 into a corresponding bore 25 of the supporting frame support 20, in a swiveling manner, thus allowing the swiveling movement of said supporting frame 23 around a rotation axis C which is perpendicular to the axis B of the rotation of said supporting frame support in the radially extending plane.

Each refractory plate supporting frame 23 ends in a fork 26, supporting a refractory insert plate 27, bearing on the supporting fork 26 by means of two coaxial pins 28, adapted to pivot in two notches 29 of the supporting fork 26, thus allowing the swiveling movement of the refractory insert plate 27 around an axis D substantially parallel to the axis B of the rotation of the supporting frame support 20 together with the supporting frame 23, in the radially extending plane A.

The lateral edges 27*a* of each pair of adjacent refractory insert plates 27 form with respect to each other a substantially tight seal for molten metal, thanks to their particular shape and possibly to a lining of for instance ceramic refractory wool covering said edges.

In the rotary slide gate mechanism shown in FIGS. 1 to 4, six refractory insert plates 27 have apertures 30, 31, 32 of three different cross sections, whereas the remaining two refractory insert plates 27 have an entirely closed surface 33.

The rotary slide gate mechanism according to the invention, shown more particularly in FIGS. 1 to 4, further comprises one central lever designated by the reference character 34, urging the refractory plate 27 which is located or moving in front of the vessel outlet 4, and two lateral levers 35 and 36, urging the refractory plates 27 which are approaching and leaving the position in front of the vessel outlet 4.

Each of the pushing levers 34, 35 and 36 are provided with independent force supplying means, whereby only the force supplying means 37 (such as a spring or a jack) corresponding to the central lever 34 is shown in FIG. 1. The three levers 34, 35 and 36 are hinged on a common axle 38 fixed to the outer surface of the shaft socket 13.

The central pushing lever 34 consists of two parallel legs 40, 41 extending along opposite sides of the central shaft 9. Said two parallel legs 40 and 41 are connected to each other, on the one end, by means of one transverse piece 42 provided at the extremities of said parallel legs 40, 41 remoted from the vessel outlet 4, and on the other end by a transverse beam 43, provided at the extremities of said parallel legs near the vessel outlet.

The transverse piece 42 is thereby adapted to be urged by the force supplying means 37, whereas the transverse beam 43 is adapted to transmit the pushing force of said force supplying means 37 to the supporting frame support 20 which is located or moving in front of the vessel outlet 4, so as to urge the refractory insert plate 27 bearing on said supporting frame support 20 towards the vessel outlet 4.

The two lateral levers 35 and 36, extending on each side of the central lever 34 having two parallel legs 40, 41, are also each provided, at their extremities near the vessel outlet 4, with one transverse beam 44, 45, adapted to transmit the pushing force of the individual force supplying means (not shown) acting respectively on the levers 35 and 36, to the supporting frame supports 20 which are approaching and leaving the position in front of the vessel outlet 4, so as to urge the refractory insert plates 27, bearing on said supporting frames 20 approaching and leaving the position in front of the vessel outlet 4, towards said outlet 4.

Figure 5:
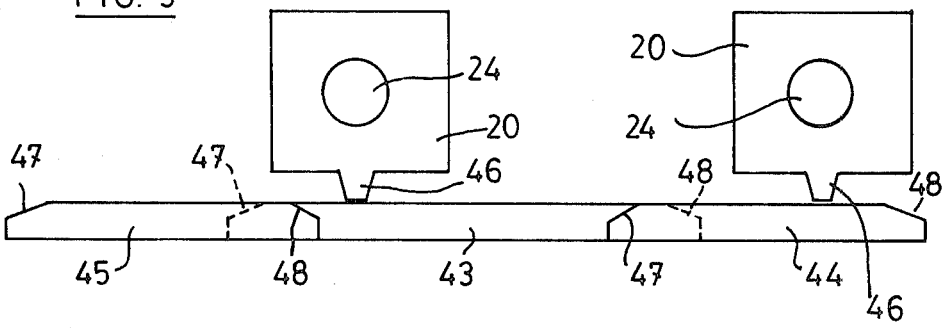
FIG. 5 is a plan view according to the direction of arrowhead X in FIG. 3, of the extremities of the pushing levers of the mechanism of FIGS. 1 to 4.

The transverse beams 43, 44, 45 of the pushing levers 34, 35, 36, which transmit the pushing forces of the individual force supplying means of said respective pushing levers 34, 35, 36, to the supporting frame supports 20 which are located and moving above said beams 43, 44, 45, through studs 46 provided on said supporting frame supports 20, each have their respective lengths so adapted that each transverse beam 43, 44, 45 can only be in contact with one stud 46 of one supporting frame support 20 at the same time, as shown more particularly in FIG. 5.

Figure 3:
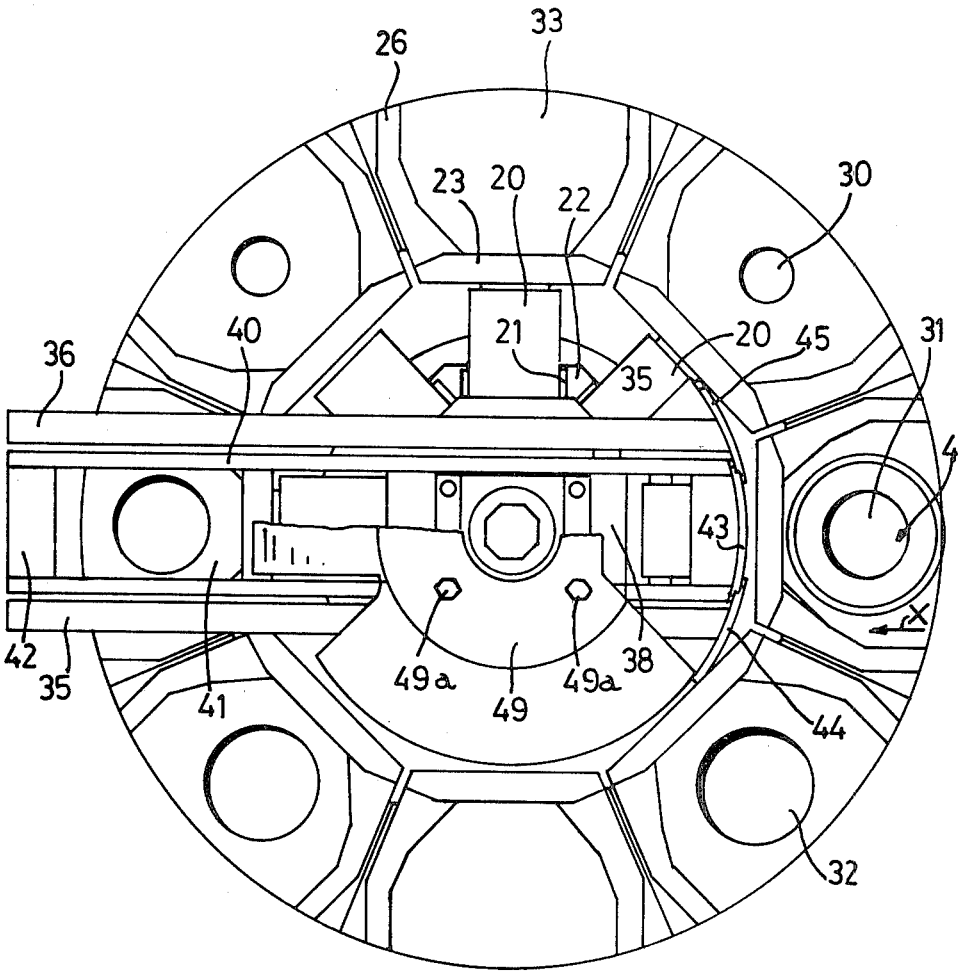
FIG. 3 is a bottom plan view of the mechanism of FIG. 1, with partially removed parts.
Figure 4:
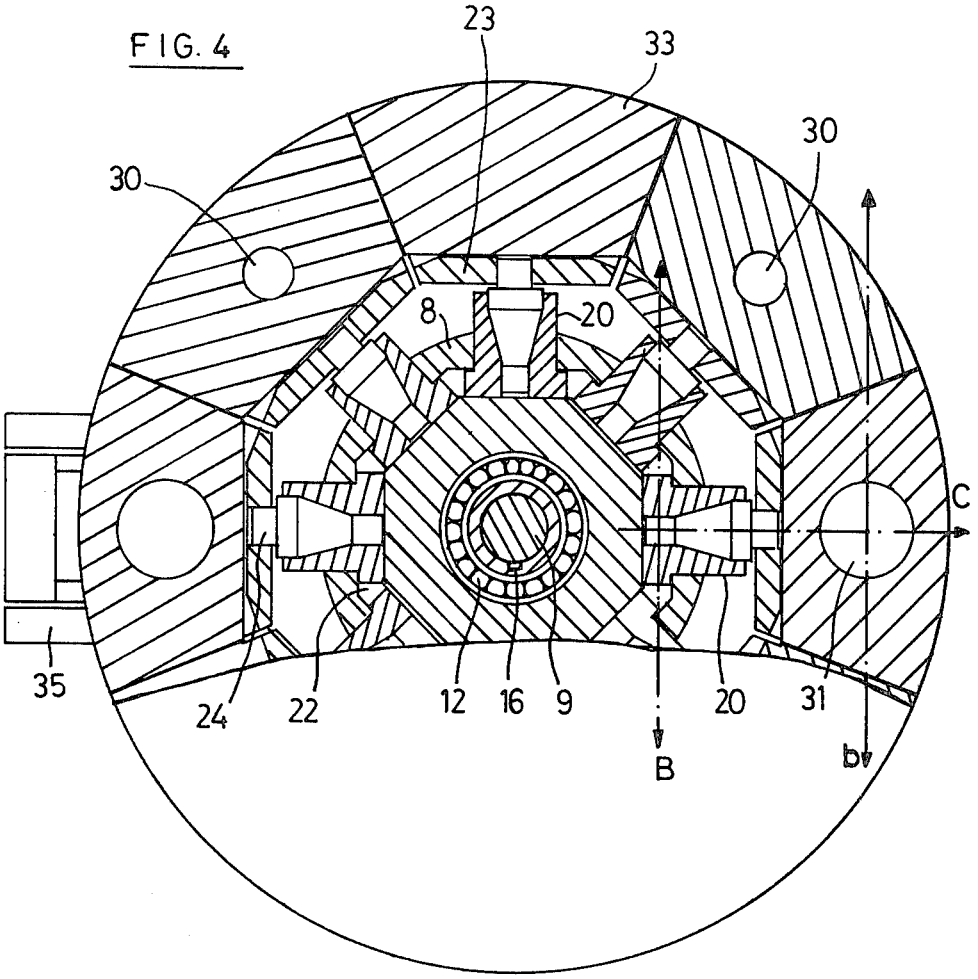
FIG. 4 is a section view according to the plane IV—IV of FIG. 1.

As shown in particular in FIG. 3, the lateral transverse beams 44, 45 are partially superimposed in the radial direction in respect to the central shaft 9, to the central transverse beam 43, and, as shown in particular in FIG. 5, each of the transverse beams 43, 44, 45 is bevel-edged at both extremities to inclined surfaces 47, 48. This particular arrangement of the beams 43, 44, 45 does allow the studs 46 of the supporting frame supports to more easily engage onto the upper surface of the lateral beams 44 or 45 when approaching said beams 44 or 45, and to more easily pass from the upper surface of the lateral beams 44 or 45 to the upper surface of the central beam 43, without any undesired descontinuity in the urging of the refractory plate supporting frames 23 towards the vessel outlet 4, when the supporting frame supports 20 move over the surface of the transverse beams 43, 44 and 45.

The particular rotary slide gate mechanism according to the invention, as shown in FIGS. 1 to 4 further comprises a cover frame 49, attached to the shaft socket 13 by means of bolts 49a.

In the area, where the supporting frame supports 20 do not bear upon the transverse beams 43, 44, 45 through the studs 46 of said supporting frame supports 20, these supporting frame supports 20 bear upon the cover frame 49 so as to limit the free swiveling movement of the supporting frame supports 20 around their pins 21 engaged into the corresponding slots of the rotary frame 8.

The rotary slide gate mechanism according to the invention as shown in particular in FIGS. 1 to 4, further comprises a driving gear-wheel 50 attached to the rotary frame 8 by means of bolts 51.

This driving gear-wheel 50 is actuated by a driving and transmission system (not shown), known per se. Thus the driving and transmission system may for instance consist of an electromotor and gear wheels, able to inpart a rotary movement to the driving gear wheel 50 attached to the rotary frame 8.

In particular said driving and transmission system may have two or more forward and reverse speeds so as to allow the rotary slide gate mechanism according to the invention to be operated in both directions at two or more different speeds.

Figure 6:
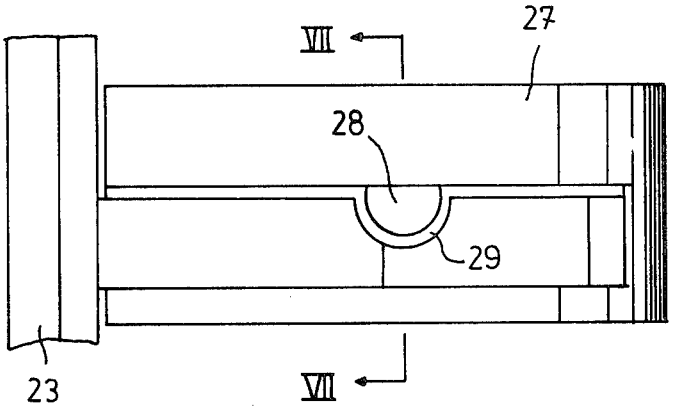
FIG. 6 is an enlarged side plan view of one refractory plate supporting frame and one refractory plate of the rotary slide gate mechanism according to FIGS. 1 to 4.
Figure 7:
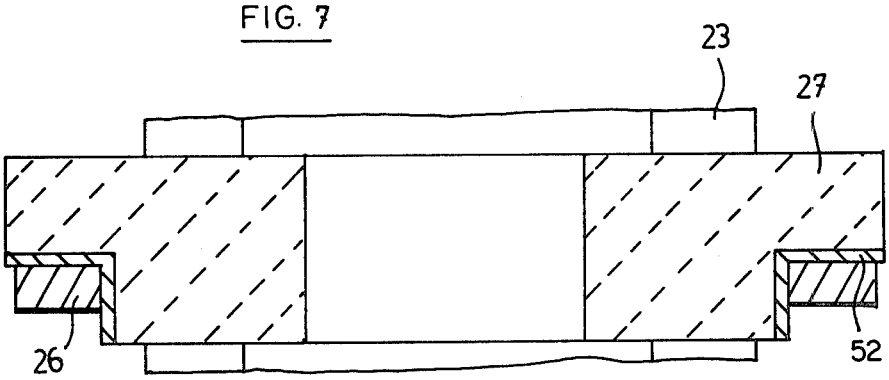
FIG. 7 is a section view along the line VI—VI of FIG. 6.

In FIGS. 6 and 7 is shown an enlarged representation of a refractory plate supporting frame 23, ending in a fork 26, supporting a refractory insert plate 27, bearing on the supporting fork 26 by means of the pins 28 pivoting in the notches 29 of the supporting fork 26.

As shown in particular in FIG. 7, the refractory insert plates 27 of the rotary slide gate mechanism according to the invention shown in FIGS. 1 to 4, are provided with a steel envelope 52 protecting the surface of the refractory insert plate 27 which is in contact with the fork 26 of the supporting frame 23.

The entire rotary slide gate mechanism according to the invention shown in particular in FIGS. 1 to 4, may, in a convenient manner, be installed as a whole on, and removed as a whole from the pour vessel 3 and the central shaft 9 attached thereto by screwing or unscrewing the sole retaining bolt 14 of the mechanism to or from the central shaft 9.

Furthermore, each of the supporting frame supports 20 may be removed together with its refractory plate supporting frame 23 from the mechanism by tilting the supporting frame 23 and/or the supporting frame support 20 in the direction of arrow Y, in an area where they are not urged by the pushing levers 34, 35, 36, so as to disengage the pins 21 of the supporting frame supports 20 from the corresponding notches 22 in the rotary frame 8.

Thus it is possible to remove one supporting frame support 20 and one refractory plate supporting frame 23 from the mechanism, and to rotate the mechanism so that the thus obtained empty position on the rotary frame 8 is brought in front of the vessel outlet 4, thus allowing unlimited access to the upper plate 7 and the associated refractory components 5, 6 of the vessel outlet 4, and easy working thereon when required.

Finally each refractory plate 27 may easily be removed from its supporting fork 26 and/or replaced by another refractory plate 27, which may be convenient for instance when a refractory plate 27 has become worn or damaged or when a refractory plate 27 having an aperture of another cross section and/or shape is needed.

The rotary slide gate mechanism according to the invention, as shown in particular in FIGS. 1 to 4, is operated by imparting a rotary movement to the rotary moving frame 8, through the driving gear-wheel 50, so as to bring one refractory insert plate 27, and possibly one aperture therein, of suitable cross section and/or shape (30, 31 or 32), in front of the aperture in the outlet upper plate 7.

Thanks to the constant positive pushing force of the levers 34, 35, 36 and the free swiveling suspension of the refractory insert plates 27 in more than one direction, said plates 27 approach their work position at the vessel outlet 4, in a self adjusting position in respect to the surface of the upper plate 7.

When during pouring the flow of molten metal has to be modified or interrupted, the rotary gate mechanism is brought in rotation so as to bring the desired refractory plate 27 or refractory plate portion in front of the vessel outlet 4. In this connection it must be emphasized that according to the relative shape and/or cross section of the apertures in the refractory insert plates and to the size of the refractory insert plates themselves, more than one aperture may be provided in each refractory insert plate 27, so that in order to modify the flow of molten metal it could be sufficient to rotate the rotary mechanism of the invention to only such an extend that another aperture of the same refractory insert plate 27 is brought in front of the vessel outlet 4; in the same manner it may be possible, in order to interrupt the flow of molten metal, to position a refractory insert plate 27 in front of the vessel outlet 4 in such a way that a closed portion of said refractory insert plate 27 closes the vessel outlet 4; it must further also be emphasized that in order to modify the flow of molten metal it may be convenient to locate one specific aperture (30, 31, 32) of a refractory insert plate 27, only partially in front of the vessel outlet.

The flow of molten metal may not only be changed in a discrete manner by changing the aperture 30, 31, 32 which is positioned in front of the vessel outlet 4, according to one relatively fast forward or reverse rotation of the rotary slide gate mechanism of the invention, but said flow of molten metal may also be regulated in a practically uniform manner by rotating the rotary mechanism of the invention at another, slower, forward or reverse speed, so as to uniformly modify the coinciding portion of the aperture 30, 31, 32 in the refractory insert plate 27 and the aperture of the upper plate 7, by a kind of throttling effect.

The regulation of the flow of molten metal may thereby be performed by a manual control of the rotation movement of the mechanism, or by automatic control means acting on the rotation movement of the mechanism, and adjusting the position and movement of the rotary moving frame 8 as a function of the changing flow of molten metal through the vessel outlet 4. Such automatic control means could for instance conveniently be electrical.

The rotary slide gate mechanism according to this invention thus allows a safe control of the flow of molten metal through at least one outlet in a pour vessel shell, whereby the rotating refractory insert plates are closely self adjusting to the upper plate of the vessel outlet and are at their work position always urged by a constant and positive pressure towards the vessel outlet.

The force supplying means bringing about said constant and positive pressure, which may in particular be selected from springs, hydraulic or pneumatic jacks, counterweights, magnets, electromagnets etc., are located out of the rotary moving portion of the mechanism and more particularly out of the heat radiating area of the vessel outlet, thus avoiding or reducing the damages and wear of the force supplying means caused by the contact with hot elements and the exposure to heat radiation.

The various characteristic arrangements of the rotary slide gate mechanism according to the invention result in a number of interesting properties, which are a consequence of or come in addition to the advantages and possibilities of the mechanism already stated in the above description:

the mechanism is safe in operation, the mechanism is easy in maintenance, the mechanism allows the use of a reduced number of force supplying means, the mechanism allows a reduced perfection in the quality of the plate dimensional manufacturing and finishing, the mechanism allows reduced wear of its various parts, in particular of its refractory insert plates and of the force supplying means, the mechanism allows the choice of multiple apertures for controlling flow of molten metal in a compact assembly.

In view of the above specification of the invention it must be evident that said invention is not limited to the details disclosed in the specific description hereabove of one embodiment thereof, and that numerous modifications may be provided to said details without leaving the general outline of the invention.

Thus, whereas the invention has been specifically described with reference to a circular embodiment of its rotary slide gate mechanism, it must be clear that other embodiments are concevable, such as for instance an embodiment in which the mechanism only covers a section of a circle, able to rotate according to a two-directional angular movement around a central shaft.

Thus also, whereas the invention has been described specifically with reference to a pour vessel having one outlet, the rotary slide gate mechanism according to the invention could easily be adapted to work on a pour vessel having more than one outlet, whereby two or more outlets could work intermittently or simultaneously. Such a rotary slide gate mechanism according to the invention adapted for more than one outlet in the vessel bottom should of course comprise one pushing system for each work position of the mechanism.

In the same manner, whereas the invention has been described specifically with reference to a mechanism in which the system for imparting a rotary movement to the rotary moving frame of the mechanism, consists of a driving gear-wheel, an electro-motor and transmission gears, it must be clear that any system producing a rotary movement could be applied and that for instance the rotary movement could be transmitted to the rotary moving frame by means of pinions, chains, pulleys, etc.

What I claim is:

1. A rotary slide gate mechanism for use on a pour vessel to control flow of molten metal through an outlet in the vessel shell, said mechanism comprising:

a moving frame able to rotate in a plane substantially parallel to the outlet in the vessel shell, around a central shaft fixed to the vessel shell;

at least two refractory plate supporting frames on the periphery of said rotary moving frame and connected thereto by means of a connection allowing each supporting frame to swivel on the one end in a rotation plane extending radially in respect to said central shaft, and on the other end around a rotation axis which is perpendicular to the axis of the rotation of said supporting frame in said radially extending rotation plane;

a number of interchangeable refractory insert plates, each plate being supported by one supporting frame in such a manner that said refractory insert plates are able to swivel around an axis which is substantially parallel to the axis of a rotation of said supporting frame in said radially extending rotation plane, whereby the lateral edges of two adjacent refractory insert plates form with respect to each other a substantially tight seal and whereby at least one of said refractory insert plates has an aperture which may be brought in alignment with the outlet in the vessel shell;

a pushing system for urging said refractory plate supporting frames, when they are in the vicinity of the outlet in the vessel shell, towards said outlet, said pushing system comprising lever means and force supplying means, removed from the heat radiating area of said outlet, acting on said lever means;

a system for imparting a rotary movement to the rotary moving frame of the mechanism; whereby the refractory insert plates may be moved in very close cooperating contact with a perforated refractory plate for the outlet in the vessel shell, so as to control the flow of metal therethrough.

2. A rotary slide gate mechanism according to claim 1, which is, as a whole, supported by said central shaft, and may, as a whole, be removed from said central shaft and from the pour vessel on which it is used.

3. A rotary slide gate mechanism according to claim 1, in which each refractory plate supporting frame is connected to a supporting frame support by means of a spindle of said supporting frame extending radially with respect to said central shaft into a corresponding bore of the supporting frame support, in a free swiveling manner, thus allowing the swiveling movement of said supporting frame around said rotation axis, which is perpendicular to the axis of the rotation of said supporting frame in said radially extending rotation plane, said supporting frame support being itself connected to the rotary moving frame by means of a connection allowing the supporting frame support to swivel together with said supporting frame in said radially extending rotation plane.

4. A rotary slide gate mechanism according to claim 3, in which each supporting frame support is connected to the rotary moving frame by means of pins engaged into slots, the common axis of said pins extending perpendicularly to said radially extending rotation plane, thus allowing the swiveling movement of said supporting frame support together with said supporting frame, in said radially extending rotation plane, and the easy removal of said supporting frame support together with said supporting frame, by tilting, in an area where said supporting frame is not urged by said pushing system.

5. A rotary slide gate mechanism according to claim 3, in which the lever means acts upon the supporting frame support.

6. A refractory slide gate mechanism according to claim 5, in which the lever means comprises near its end acting upon the supporting frame support a transverse beam, the length of which is such that it can only be in contact with one supporting frame support at the same time.

7. A rotary slide gate mechanism according to claim 3, which comprises a fixed cover frame adapted to support the supporting frame supports in the area where the refractory plate supporting frames are not urged by the pushing system.

8. A rotary slide gate mechanism according to claim 1, in which each refractory insert plate bears upon one supporting frame by means of a hinge, the swivel axis of which is substantially parallel to the axis of the rotation of said supporting frame in said radially extending rotation plane.

9. A rotary slide gate mechanism according to claim 8, in which each refractory insert plate comprises two coaxial pins adapted to pivot in two notches on one supporting frame.

10. A rotary slide gate mechanism according to claim 8, in which each refractory insert plate comprises two notches adapted to pivot on two coaxial pins of one supporting frame.

11. A rotary slide gate mechanism according to claim 1, in which the lever means of the pushing system urging the refractory plate supporting frames, when they are in the vicinity of the outlet in the vessel shell, towards said outlet, has its fulcrum located between the point where the lever means urges said refractory plate supporting frames and the point where said force supplying means act upon said lever means.

12. A rotary slide gate mechanism according to claim 1, in which the lever means acts upon the refractory plate supporting frames.

13. A rotary slide gate mechanism according to claim 9, in which the lever means comprises near its end acting upon the refractory plate supporting frames, a transverse beam, the length of which is such that it can only be in contact with one refractory plate supporting frame at the same time.

14. A rotary slide gate mechanism according to claim 1, in which the pushing system urging the refractory plate supporting frame, in the vicinity of one outlet in the vessel shell, comprises three levers, each of said levers being provided with independent force supplying means, whereby one of said levers urges the refractory plate supporting frame located in front of the outlet in the vessel shell, whereas the two remaining levers are adapted to urge the refractory plate supporting frames approaching and leaving the position in front of the outlet.

15. A rotary slide gate mechanism according to claim 1, in which the lever means urging the refractory plate supporting frame located in front of the outlet in the vessel shell consists of two parallel legs extending along opposite sides of said central shaft and connected to each other by means of at least two transverse pieces at the extremities of said legs, whereby one transverse piece is adapted to urge said supporting frame located in front of the outlet and one transverse piece is adapted to be urged by its force supplying means, and in which the levers urging the refractory plate supporting frames approaching and leaving the position in front of the outlet in the vessel shell extend on each side of said central lever having two parallel legs.

16. A rotary slide gate mechanism according to claim 1, in which the fulcrum of the lever means is positioned near the central shaft of the mechanism, whereby the one extremity of the lever means urges said refractory plate supporting frame towards one outlet in the vessel shell, whereas the other extremity of the lever means extends in an opposite direction to a point which is outside the periphery of the rotary moving frame and of the supporting frames connected thereto, the force supplying means being located at that point.

17. A rotary slide gate mechanism according to claim 1, which comprises a fixed cover frame, adapted to support the refractory plate supporting frames in the area where they are not urged by the pushing system.

18. A rotary slide gate mechanism according to claim 1, in which the force supplying means are selected from the group comprising springs, hydraulic or pneumatic jacks, counterweights, magnets, and electromagnets.

19. A rotary slide gate mechanism according to claim 1, in which said supporting frames consist of forks supporting, in a free swiveling manner, the lateral edges of said refractory insert plates.

20. A rotary slide gate mechanism according to claim 1, in which the rotary moving frame is supported on bearings.

21. A rotary slide gate mechanism according to claim 1, in which the system for imparting a rotary movement to the rotary moving frame consists of a motor and gears transmitting the motion of the motor to a driving gear provided on said rotary moving frame.

22. A rotary slide gate mechanism according to claim 21, in which the motor is an electromotor.

23. A rotary slide gate mechanism according to claim 1, in which the rotary movement of the rotary moving frame may perform in both directions.

24. A rotary slide gate mechanism according to claim 1, in which the rotary movement of the rotary moving frame may be performed at at least two different speeds.

25. A rotary slide gate mechanism according to claim 1, wherein at least one of the refractory insert plates has an entirely closed surface of refractory material.

26. A rotary slide gate mechanism according to claim 1, in which at least five refractory plate supporting frames are arranged on the periphery of said rotary moving frame.

* * * * *